United States Patent [19]

Doerfel

[11] Patent Number: 4,932,599

[45] Date of Patent: Jun. 12, 1990

[54] CORE LOADING MECHANISM FOR WEB CUTTING MACHINES

[75] Inventor: Gerhard W. Doerfel, Boll, Fed. Rep. of Germany

[73] Assignee: Beloit Corporation, Beloit, Wis.

[21] Appl. No.: 267,137

[22] Filed: Nov. 4, 1988

[30] Foreign Application Priority Data

Nov. 5, 1987 [DE] Fed. Rep. of Germany ..... 3737503

[51] Int. Cl.[5] ..... B65H 19/30; B65H 19/22; B65H 19/26

[52] U.S. Cl. ..... 242/56.4; 242/56 R; 242/56.9; 242/66

[58] Field of Search ..... 242/35.5 A, 56 R, 56 A, 242/56.1-56.9, 55, 65, 66, 68.4

[56] References Cited

U.S. PATENT DOCUMENTS

| | | | |
|---|---|---|---|
| 3,239,155 | 3/1966 | Kinoshita | 242/66 |
| 4,508,283 | 4/1985 | Beisswanger | 242/56.4 |
| 4,534,517 | 8/1985 | Muramatsu et al. | 242/35.5 A |
| 4,726,533 | 2/1988 | Droczynski | 242/56 R |
| 4,732,341 | 3/1988 | Ruff | 242/56.4 |
| 4,749,140 | 6/1988 | Ruff | 242/56.4 |
| 4,856,725 | 8/1989 | Bradley | 242/66 |

FOREIGN PATENT DOCUMENTS

| | | | |
|---|---|---|---|
| 324399 | 5/1984 | Fed. Rep. of Germany . | |
| 362902 | 3/1988 | Fed. Rep. of Germany . | |
| 886774 | 1/1962 | United Kingdom | 242/56 A |

*Primary Examiner*—John Petrakes

*Attorney, Agent, or Firm*—Dirk J. Veneman; Raymond W. Campbell

[57] ABSTRACT

A core supply apparatus for a web slitting machine which includes a receiver arranged above support rolls of the slitting machine, said receiver adapted for holding a set of winding tubes which are dimensioned in length to correspond to the width of the sub-webs resulting from the slitting operation. The winding tubes are inserted into the receiver as a complete set for all sub-webs, and are arranged coaxially end-to-end in the receiver. Upon activation of the core loading process, the winding tubes fall from the receiver into transfer elements which engage alternate tubes from alternate sides of the receiver, and separate the winding tubes toward opposite sides. The transfer elements pivot downwardly and discharge the winding tubes onto a support roll of the slitting machines or alternatively onto a guide device including angular surfaces directing the tubes onto separate winding support drums.

16 Claims, 12 Drawing Sheets

CORE LOADING MECHANISM FOR WEB CUTTING MACHINES

BACKGROUND OF THE INVENTION

The present invention relates generally to the field of paper winding machines, and relates more specifically to a core loading apparatus associated with a slitter, in which a wide web is subdivided into narrower sub-webs and the individual sub-webs are wound on individual cores alternately located on spaced winding drums.

In known roll slitting or cutting machines, a wide web is slit longitudinally into a plurality of sub-webs, and adjacent sub-webs are alternately directed to winding stations at spaced locations. In a typical such installation, two winding drums are provided and alternate sub-webs are rewound thereon along axes substantially in alignment. In the typical biwinder or duplex winder of the type described, the individual winding stations for each of the sub-webs produced by the slitter each have associated therewith an individual core loading magazine, and the magazine for each contains a number of winding tubes or cores which correspond with the width of the sub-webs. When a change is made in the slitting operation to a different cutting program, and a new width of sub-web is required, all the magazines for the individual core loading stations must be cleared of the existing cores and resupplied with new cores of the proper size for the new width of sub-webs being created.

Clearing the core loading magazines of existing cores and reloading the magazines with new cores can be quite time consuming, and significantly delays the start of a new slitting operation.

It is therefore one of the principal objects of the present invention to provide an automatic core loading apparatus for supplying cores automatically to winding stations following a slitter.

Another object of the present invention is to provide a core loading apparatus which can be changed quickly and efficiently from operation for loading one size of cores to an operation for loading a different size cores when an alternate slitting program is to begin.

Yet another object of the present invention is to provide an automatic core loading apparatus for individual winding stations following a slitter, which handles cores smoothly and efficiently, minimizing jamming and misalignment of the cores.

SUMMARY OF THE INVENTION

These and other objects are achieved in the present invention by providing a receiver in which a set of winding tubes is introduced which are intended for all sub-webs made from the original wide web by the longitudinal slitting operation. The receiving means contains, at any one time, only one such set of cores. The next set of cores can be prepared during the winding of the sub-rolls. Assembly of the next set of cores is done outside the roll cutting machine, and cores of any desired widths of the sub-webs can be gathered. An alternate set can be pushed up instead of the previous set. Therefore, at most, only one set of cores needs to be replaced if a change is made to the width of sub-webs being created, and clearing and reloading of several winding tube magazines is therefore no longer necessary.

The core loading operation itself is also simplified insofar as only one particular set is pushed lengthwise into the receiver, means and the individual winding tubes or cores are subsequently distributed among the take-up units of the various winding stations of the sub-webs.

In the receiver, the winding tubes or roll cores are arranged coaxially in an end-to-end relationship. To initiate the separation of the winding tubes for the take-up units arranged along the one winding axis, from those of the take-up units arranged along the other winding axis, which often are on separate winding drums, in the preferred embodiment of the invention, there is associated with the receiver a transfer mechanism in which the winding tubes intended for the take-up units of the two axes are separately gripped. The separation is thus initiated.

The transfer mechanism may have associated therewith a guide device by means of which the separated cores can be brought up to the take-up units of the two axes.

In a preferred embodiment of the invention, a duplex winder having two parallel support rollers arranged at the same level is provided, and on the support roller the winding is carried out in two groups, the winding axes of one group of take-up units aligning substantially with each other and being arranged above the one support roller, and the winding axes of the other group of take-up units aligning substantially with each other and being arranged above the other support roller. In such a roll cutting machine, it is preferred for the receiver, the transfer mechanism, and the guide device to be arranged in the center, above the two support rollers.

This preferred arrangement has a number of constructional advantages, and, in particular, makes it possible to utilize gravity to bring the winding tubes or cores onto the two support rollers, so that no special moving means are required for this purpose.

The receiver, in the preferred embodiment, may take the form of a tubular magazine comprised of two opposed concave shells or troughs into which the winding tubes or cores can be consecutively inserted lengthwise from the side of the web. On pivoting the shells or troughs apart, the winding tubes or cores drop downwardly and are gripped by the suitably constructed transfer device which can initiate the separation.

In another embodiment, the tubular magazine has a longitudinal opening as wide as the winding core diameters, and the magazine is rotatable about its longitudinal axis to move the slot from an upwardly to a downwardly directed position to release the cores. Such an embodiment may be preferred because the mounting and rotating of a tube about its longitudinal axis is easier to implement than the pivotal mounting of two long shells.

The transfer mechanism may include transfer elements which are pivoted from different sides beneath the receiving means, to take the winding cores or tubes dropping out of the receiver and move them apart upon pivoting back perpendicularly to their axis, thus initiating the separation.

The guide device, which takes over the winding tubes from the transfer elements and finally conducts them to the two support rollers, can be constructed to include elements shaped as a roof or as an inverted "v", which is easy to make and needs only to be arranged stationary beneath the transfer elements and above the support rollers. The tip of the guide elements forms an apex, on the two sides of which the transfer elements transfer or deposit the winding tubes for the two support rollers. The cores roll downwardly along the angular faces of the inverted v-shaped guide element, and are retained at the bottom by pivotally retractable stop elements until the time for transfer to the support rollers has arrived.

To prevent the winding tubes from dropping down beyond the support rollers when the stop elements are pivoted away, further stops are provided by means of which the winding tubes can be held in a position in which they can be gripped by clamping means which engage from the ends of the winding tubes. In this manner, the narrower rolls formed from the sub-webs are cleanly guided. The narrower rolls roll on the support roller or rollers. With increasing roll diameter, the support arms with the clamping means are pivoted away.

Additional objects and advantages of the present invention will be apparent from the following detailed description and the accompanying drawings.

DETAILED DESCRIPTION OF THE PREFERRED EMBODIMENTS

Figure 1:
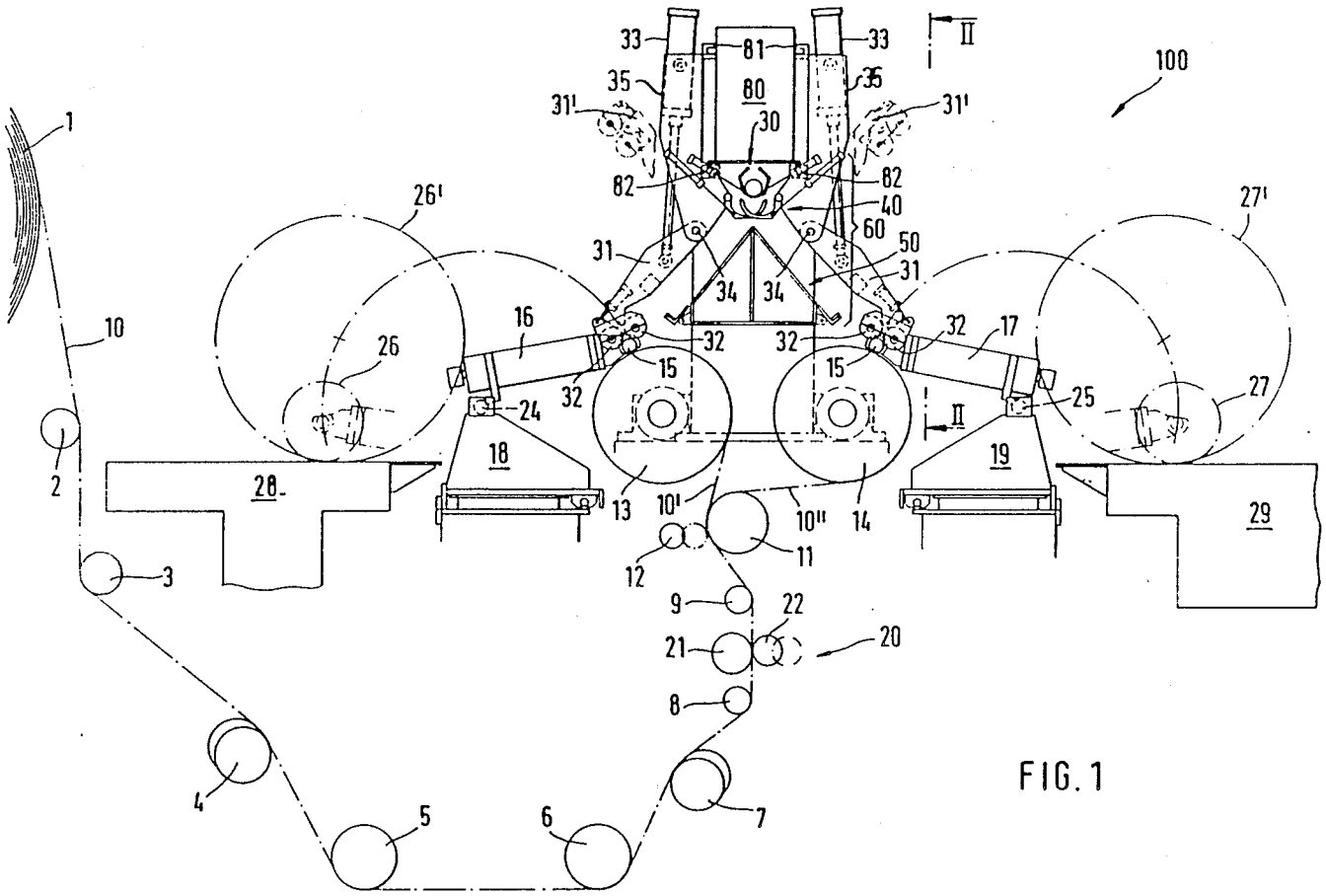
FIG. 1 is a side view of a web cutting machine having a core loading mechanism according to the present invention.

Referring now more specifically to the drawings, and to FIG. 1 in particular, a web slitting machine designated as a whole by numeral 100 draws a wide paper web 10 from a roll 1 and leads the web via guide rollers 2, 3, a spreader roll 4, two further guide rollers 5, 6 and a further spreader roller 7 to and through a cutting station which is designated as a whole by 20. The cutting station includes two guide rollers 8, 9 which are disposed one above the other and between which, for each longitudinal cut, a pair consisting of a lower blade 21 and a pivotally mounted upper blade 22 is disposed. The sub-webs created by the longitudinal cutting are conducted jointly between a guide roller 11 and a pressure roller 12, and are divided above rollers 11 and 12 in that a sub-web or narrower web 10' is conducted to the left support roller 13 in FIG. 1, and the adjacent narrower sub-web 10'' is conducted to the support roller 14, which is disposed on the right in FIG. 1 at the same level as the support roller 13. The sub-web 10' following the sub-web 10'' as viewed perpendicularly to the plane of the drawing, is again conducted to the left support roller 13, and the then again following sub-web 10'' to the right support roller and so on. Thus, adjacent sub-webs 10', 10'' are always conducted to different support rollers 13, 14.

The sub-webs 10' and 10'', which are partially wrapped around the support rollers 13 and 14, which are constructed as suction rollers and can firmly hold the sub-webs 10' and 10'', are wound onto the winding tubes or cores 15 which bear at the top of the support rollers 13, 14. The winding tubes or cores correspond in their length to the width of the sub-webs 10', 10'' and are held at their ends by clamping means which are not shown in FIG. 1 and which are arranged on support arms 16 and 17 which engage from the outside over the support rollers 13, 14 and are mounted in pairs on carriages 18, 19 which are displaceable transversely of the web 10. The support arms 16, 17 are pivotal about axes 24, 25 mounted parallel to the axes of the support rollers 13, 14 on the carriages 18, 19 to deposit finished sub-rolls 26, 26' and 27, 27' respectively, which may have very different diameters, on the tables 28 and 29 respectively, from where they are removed.

While the sub-webs 10', 10'' are wound onto the winding tubes or cores 15 to form sub-rolls rolling on the support rollers 13, 14, pressure roller pairs 32 mounted on roller cranks 31 pivotal about transverse axes 34 bear on the sub-rolls from above and ensure the formation of firm and uniform rolls. The roller cranks or oscillating arms 31 are pivotable by means of the linear actuators 33 which are constructed for example as pneumatic cylinders, and which, on the one hand, pivot the roller cranks 31 to an inoperative position 31' indicated in dashed line in FIG. 1 and, on the other hand, can press the pressure roller pairs 32 with a predetermined force onto the forming rolls during the winding operation. Just like the support arms 16 and 17, the roller cranks 31 are pivoted corresponding to the increasing roll diameter.

Whereas the cutting station 20 is disposed beneath the support rollers 13, 14 and the material web 10 or the sub-webs 10', 10'' are brought up to the support rollers 13, 14 from below, the winding tubes or roll cores 15 are supplied by a supply apparatus which is arranged above the support rollers 13, 14 and is designated as a whole by numeral 60. The core supply apparatus includes a core receiver 30 for the winding tubes or cores, a transfer mechanism 40 and a guide device 50, which will be described in detail with reference to FIGS. 3 to 10. The core supply apparatus 60 is arranged beneath a box girder or beam 80 which extends in the center above the support rollers 13, 14 transversely over the web and includes guide rails 81, 82 which also carry the roller cranks or Oscillating arms 31 with the linear actuators 33.

Figure 2:
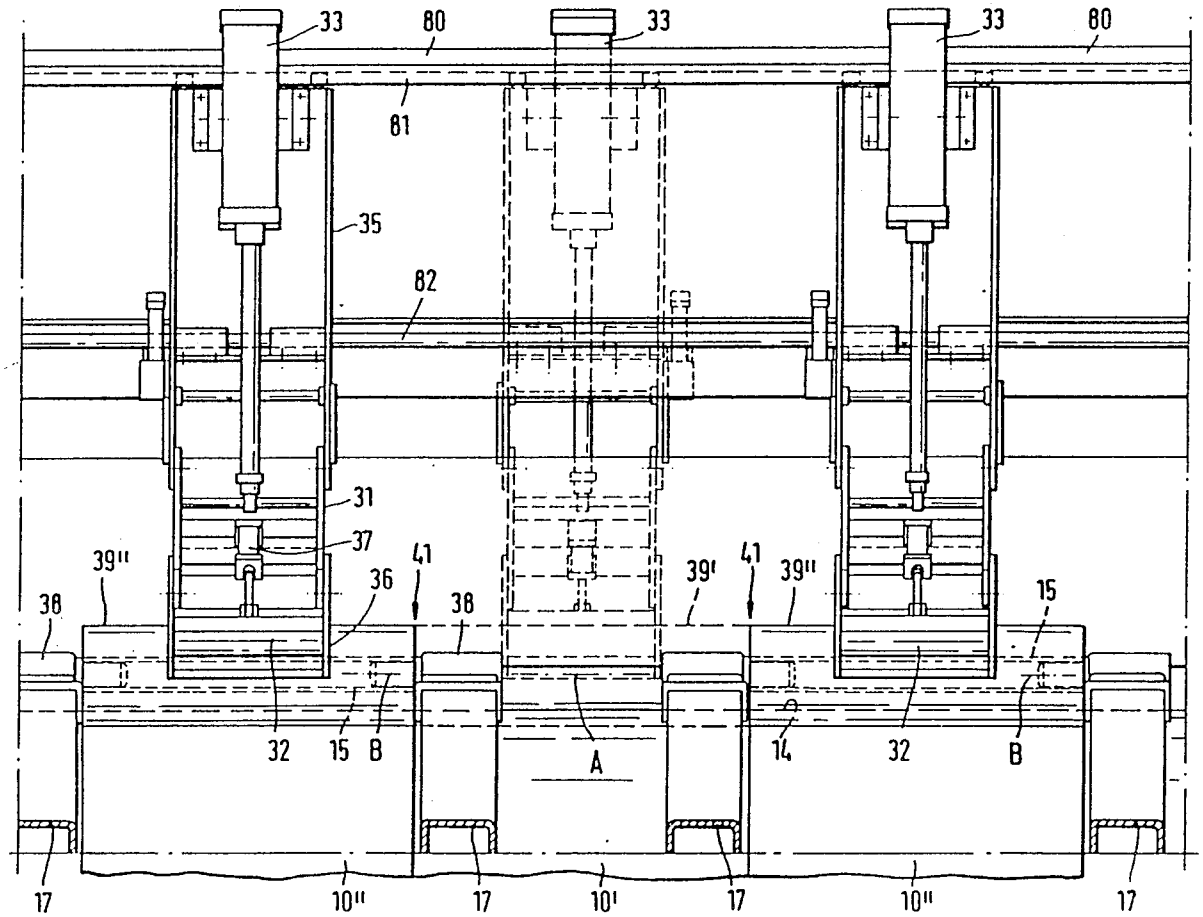
FIG. 2 is an enlarged, fragmentary view taken along the line II—II of FIG. 1.

As apparent from the side view of FIG. 2, associated with each sub-web 10', 10'' is its own take-up unit which, depending on the position of the sub-webs 10', 10'', is displaceable in the transverse direction, i.e. along the box beam 80. The take-up unit for the sub-web 10'' illustrated on the left in FIG. 2 includes the roller crank 31 which, like the linear actuator 33, is mounted pivotally about transverse axes on a carriage 35 displaceable along the guide rails 81, 82 of the box beam 80. At the free end of the roller cranks 31, the pairs of pressure rollers 32 are mounted in roller rockers 36 which are pivotal about a transverse axis with respect to the roller crank 31 by means of a linear actuator 37.

Associated with the arrangement described above is a pair of support arms 17 which include, at the free ends, clamping means 38 which engage into the winding tube or core 15 from the ends. The sub-rolls 39' and 39'' forming from the sub-webs 10' and 10'' roll on the surface of the support rollers 13 and 14 respectively, being guided by the clamping means 38, with pressure being applied by the pressure rollers 32 engaging from above. The sub-rolls 39' run on the support roller 13 and the sub-rolls 39" on the support roller 14 with the winding axes A and B. The separating points 41 correspond to the position of the longitudinal cuts formed by the blades 21 and 22. The purpose of the different winding axes A and B is apparent from FIG. 2. Although the sub-rolls 39', 39" adjoin each other at the edges, there is room for the support arms 17, 17 with the clamping means 38, 38 to be able to engage from both sides from the outside.

The position of the separating points 41 may change, depending on the number and width of the sub-webs 10', 10" into which the wide web 10 is to be divided. The sub-webs 10', 10" need not all have the same width during one slitting operation.

Depending on the position of the separating points 41 or of the sub-webs 10', 10" the cores and support arms for the individual sub-webs 10', 10" are displaced in the transverse direction of the web or in the longitudinal direction of the box beam 80, the carriages 35 being positioned such that they are arranged in the center between the associated support arm pair.

Figure 3:
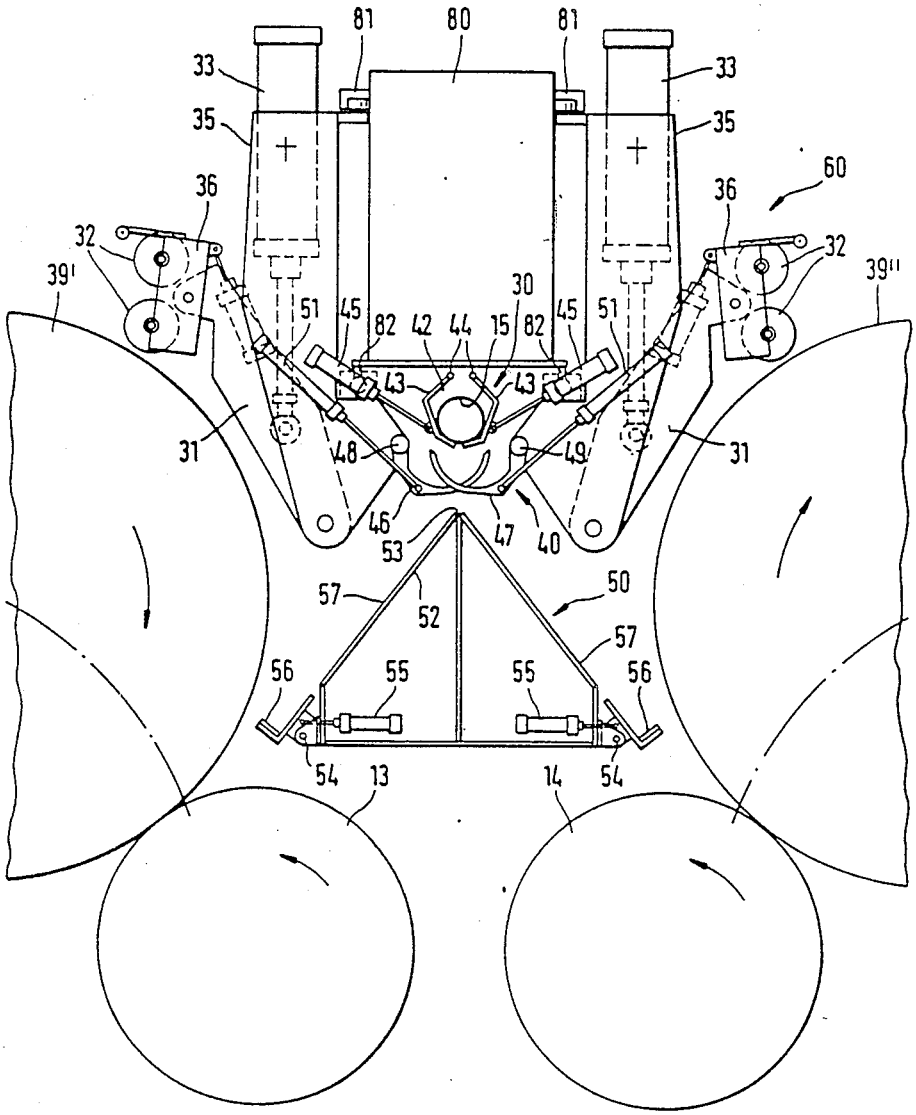
FIG. 3 is an enlarged view similar to that portion of FIG. 1 showing the core loading apparatus, support rollers, and fragmentary views of substantially fully wound rolls supported by the support rolls.

According to FIG. 3, the core receiver 30 includes a tubular tube or roll core magazine 42 which consists of two troughs or shells 43 which are curved longitudinally and face each other. The shells are mounted pivotally about transverse shafts 44 at their upper edges, and can be pivoted out of the closed position shown in FIG. 3 into the open position shown in FIG. 5 by the operation of linear actuators 45.

A set of winding tubes or cores 15 can be introduced end-to-end into the tubular magazine 42 from the side, i.e. parallel to the axes of the support rollers 13 and 14. The lengths of the winding tubes correspond to the widths of the respective sub-webs 10', 10" to be wound thereon, the tubes being arranged one behind the other and inserted in such a manner that, in the fully inserted state, the separating points between the individual winding tubes or cores 15 are located at the level of the separating points 41 (FIG. 2) of the sub-webs 10', 10".

Thus, for each winding operation in each case, only one set of winding tubes 15 is inserted into the machine. Changing to a different cutting program requires simply making ready correspondingly cut winding tubes 15 outside the machine and inserting the new set, while also displacing the carriages 35 and the support arm pairs 17, 17 accordingly.

To distribute the winding tubes 15 supplied to one point, i.e. in the receiver 30, coaxially in series among the two winding axes A, B (FIG. 9) the transfer mechanism 40 and the guide device 50 are used.

The transfer mechanism 40 is arranged directly beneath the receiver 30, and includes shell-shaped or stirrup-shaped, upwardly open transfer elements 46, 47, each associated with a single sub-web 10' or 10". The transfer elements 46 are associated with the support roller 13 and at their left edge as shown in FIG. 3 are pivotal about a transverse shaft 48 which is disposed on the left beneath the tubular magazine 42. Beginning from the transverse shaft 48, the transfer elements 46 extend beneath the tubular magazine 42 up to and beyond the center thereof. Similarly, the transfer elements 47 are associated with the support roller 14, and are pivotal about a transverse shaft 49 disposed on the right beneath the tubular magazine 42. The transfer elements 47 extend from the shaft 49 beneath the tubular magazine 42 and up to and beyond the center of the tubular magazine. The pivoting of the transfer elements 46, 47 is controlled by linear actuators 51 mounted on the carriages 35. By corresponding actuation of the linear actuators 51, the transfer elements 46, 47 can be opened beyond the position of FIG. 6 into the position of FIG. 7.

Provided beneath the transfer mechanism 40 is a guide device 50, which consists of an inverted "v" or roof-shaped carrier 52 which extends just above the support rollers 13, 14 over the entire width of the machine. The roof-shaped carrier 52 has a crosssection of substantially the shape of an upright equilateral triangle, the tip 53 forming the ridge of the "roof" being disposed in the center beneath the tubular magazine 42. Angle stops 56, pivotal about a transverse shaft 54 by means of linear actuators 55 are provided at each side of the carrier 52, and have one leg for continuing downwardly sloping surfaces 57 of the carrier 52, and another leg projecting upwardly perpendicularly to the first leg.

In FIG. 3, a working phase is shown in which the preceding winding operation has just been completed. The finished sub-rolls 39', 39" are deposited on the tables 28, 29 (see FIG. 1), which are not shown in FIG. 3. The roller cranks 31 are pivoted upwardly, and the roller rockers 36 with the pressure rollers 32 are retracted into the position shown. A new set of winding tubes 15 is inserted into the tubular magazine 42. In the working phase shown in FIG. 4, the sub-rolls 39', 39" have already been deposited on the tables, and the support arms 16 and 17, which are indicated only by their center lines, have been pivoted back into the vicinity of the support rollers 13 and 14, and are ready for clamping the new cores. The carriages 35, with the roller cranks 31 and the pressure rollers 32, are positioned on the center of the respective sub-webs 10', 10". The roller cranks 31 are pivoted downwardly so that the pressure rollers 32 are disposed in the vicinity of the support rollers 13 and 14. The roller rockers are pivoted so that the plane formed by the axes of the respective pressure roller pair extends substantially parallel to the longitudinal extent of the roller cranks 31.

Figure 5:
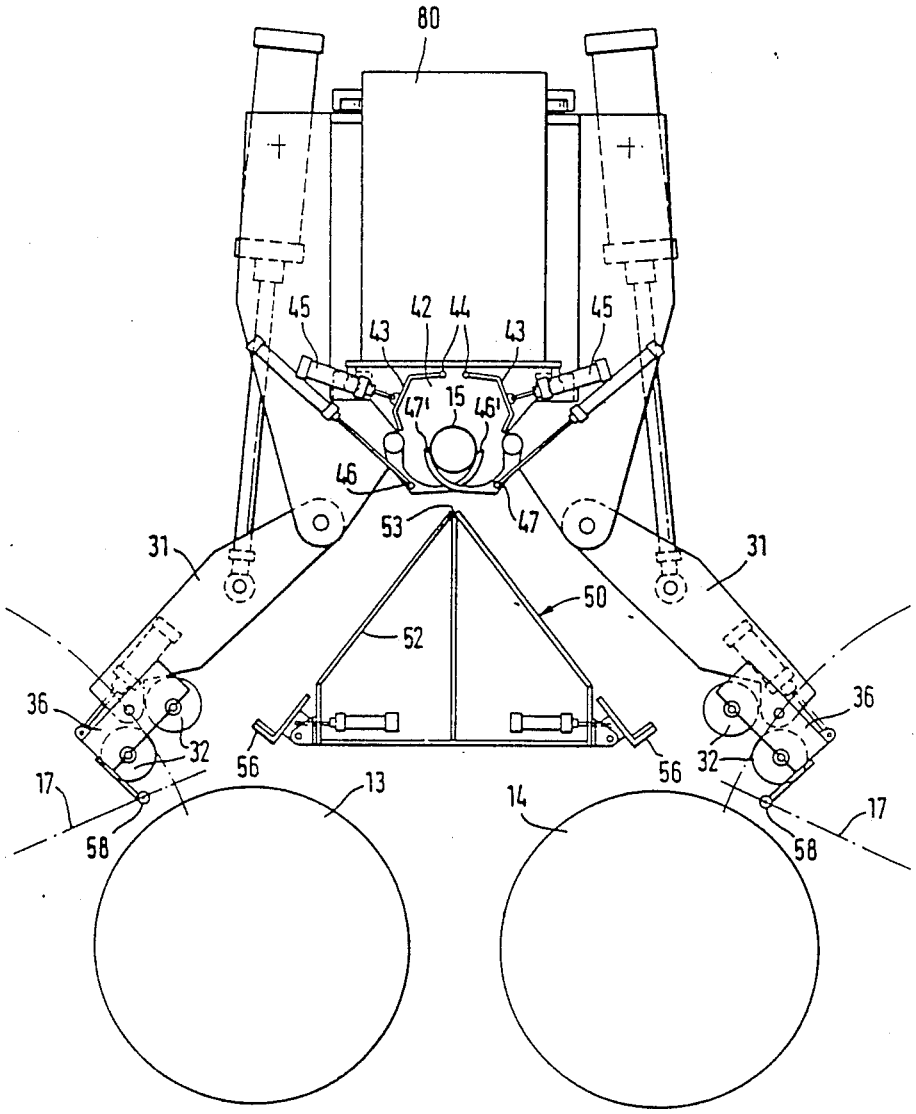

In the working phase shown in FIG. 5, the distribution of the winding tubes 15 has been initiated. By actuating the linear actuators 45 the shells 43 forming the tubular magazine 42 have been opened by pivoting about the transverse axes 44, and the winding tubes 15 have dropped out downwardly. The free ends 46' and 47' of the transfer elements 46 and 47, extending beyond the center of the tubular magazine 42, catch the respective winding tubes as the winding tubes fall from the tubular magazine. Due to the curvature of the transfer elements, the winding tubes roll from the center outwardly along the transfer element, the separation of the winding tubes 15 into the groups intended for the two support rollers 13, 14 thus being initiated. The winding tubes 15' intended for the support roller 13 move along the transfer elements 46 to the left side, according to FIG. 5, of the apex or ridge 53 of the guide device 50, and the winding tubes 15" intended for the support roller 14 move along the transfer elements 47 to the right side of the apex or ridge 53. The respective winding tubes are in stable equilibrium in the curvature of the transfer elements 46, 47.

Figure 6:
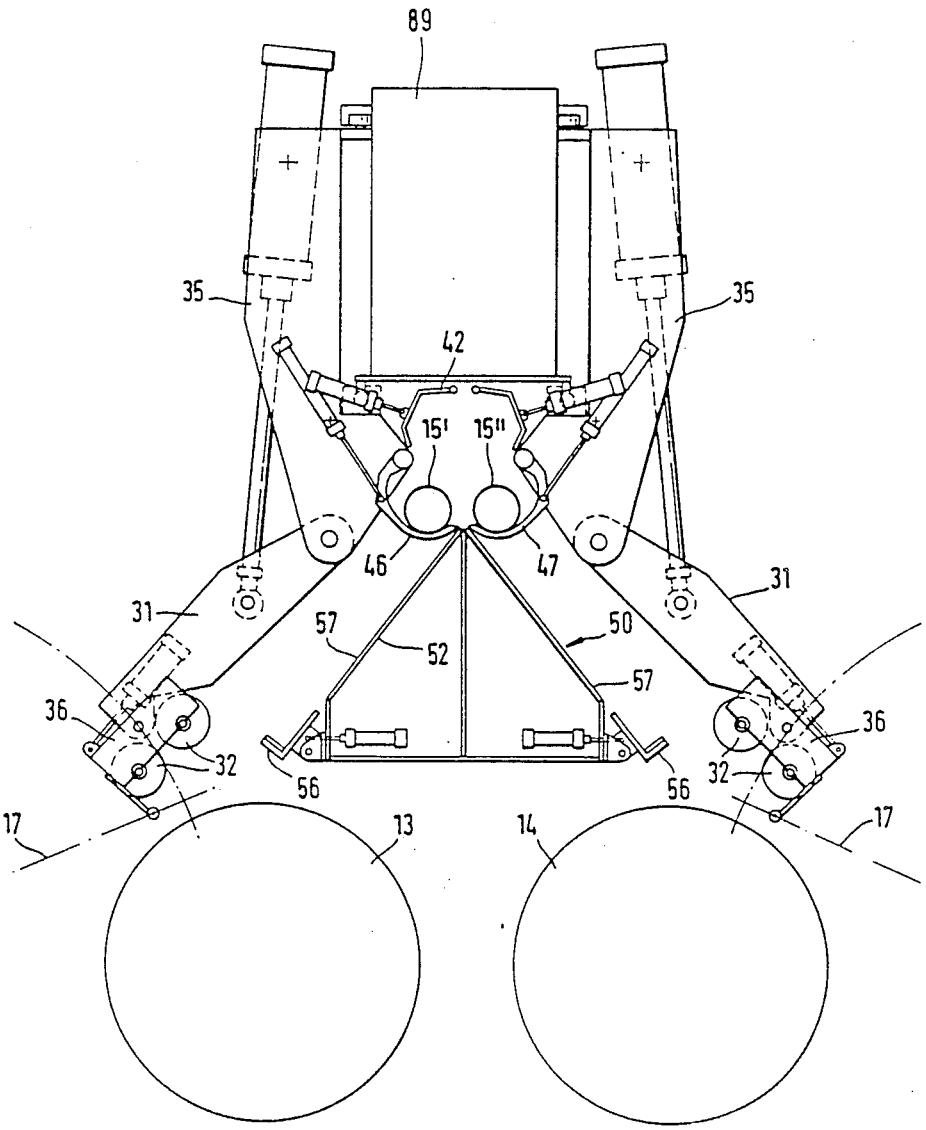

In the working phase shown in FIG. 6, the transfer elements 46 and 47 have started their outward pivotal movement while still holding the winding tubes 15', 15", the separation of which can be clearly seen in FIG. 6.

Figure 7:
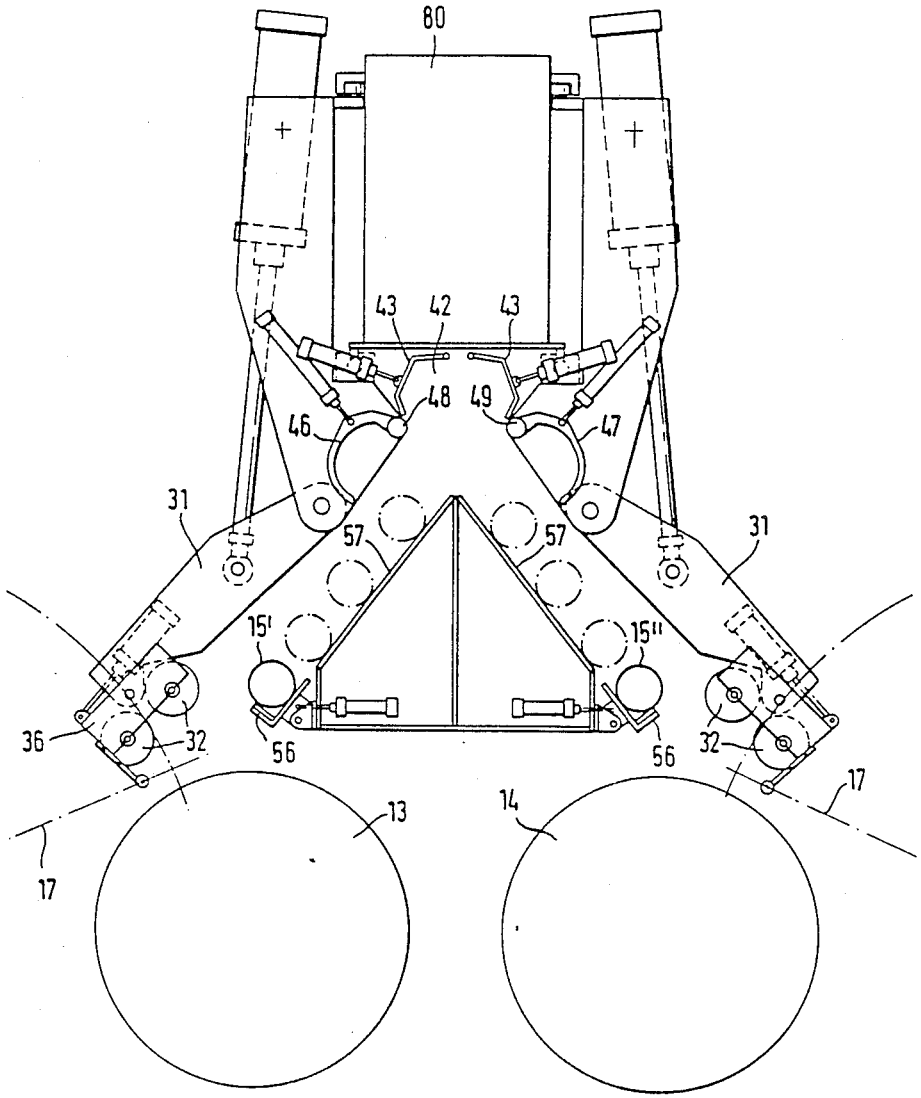

In the working phase shown in FIG. 7, the transfer elements 46, 47 have continued their outward pivotal movement to the end position and have tipped the winding tubes 15', 15" onto the downwardly sloping surfaces 57 of the roof-shaped carrier 52. The tubes immediately roll downwardly over the surfaces 57 in the manner indicated in dot-dash lines until the tubes are stopped at the angular stops 56, just above the support rollers 13, 14.

Figure 8:
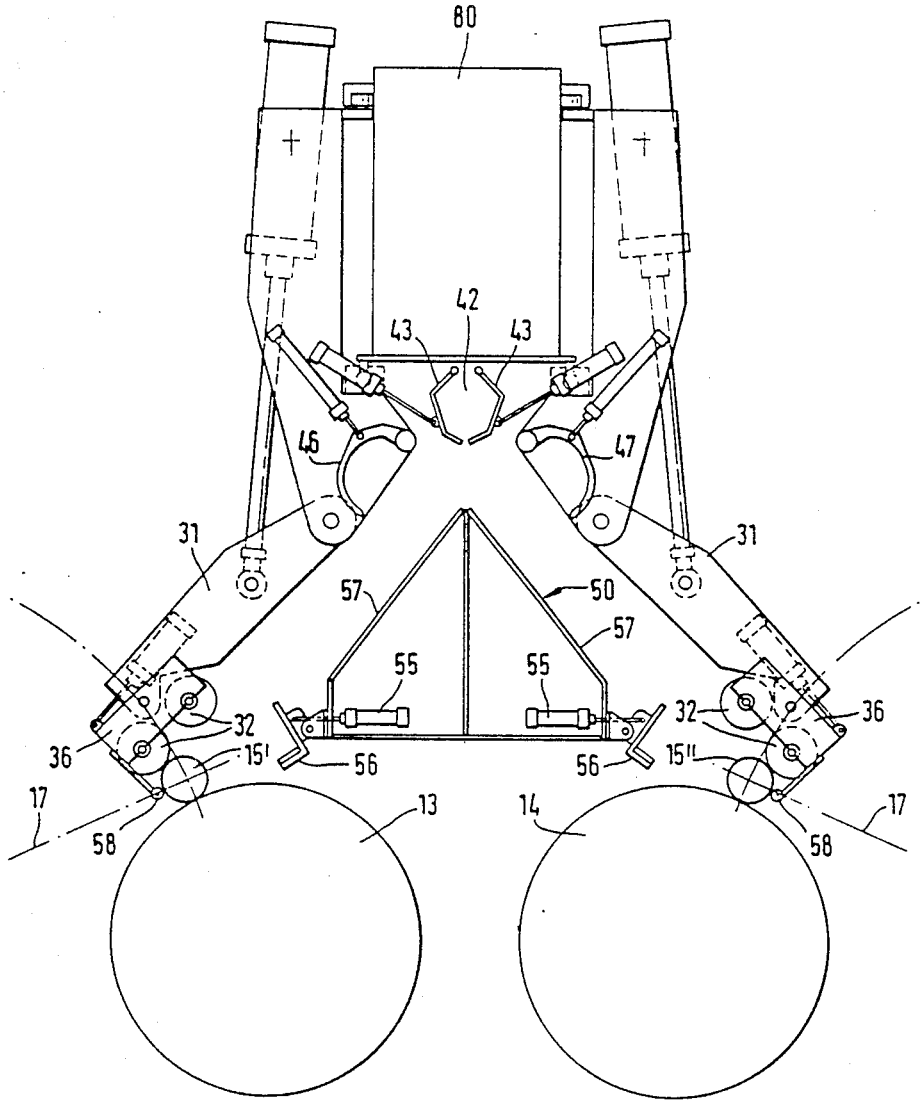

In the working phase according to FIG. 8, the angular supports 56 have been pivoted by the linear actuators 55 outwardly, and have tipped the winding tubes 15', 15" onto the support rollers 13, 14 whereupon the winding tubes move over the surface of the support rollers 13 or 14 until they come to bear on a further stop 58 which is disposed at the outer end of the roller rockers 36 and formed by a rod, or the like, extending in the transverse direction, and which is arranged beneath the pressure rollers 32, 32. The roller cranks 32, since the working phase of FIG. 4 have retained their position which, as apparent in particular from FIG. 8, is such that it does not obstruct the rolling of the winding tubes 15', 15" over the angular stops 56 and the upper side of the support rollers 13, 14 but nevertheless permits the defined retaining of the winding tubes 15', 15" by the further stops 58 beneath the outer pressure roller 32.

In the position shown in FIG. 8, the winding tubes 15', 15" are gripped by the clamping means 38 disposed at the ends of the support arms 17 (FIG. 2).

The shells 43 forming the tubular magazine 42 have meanwhile again been pivoted together, in readiness to receive a new set of cores or tubes 15. The transfer elements 46, 47 are still in the open position.

Figure 9:
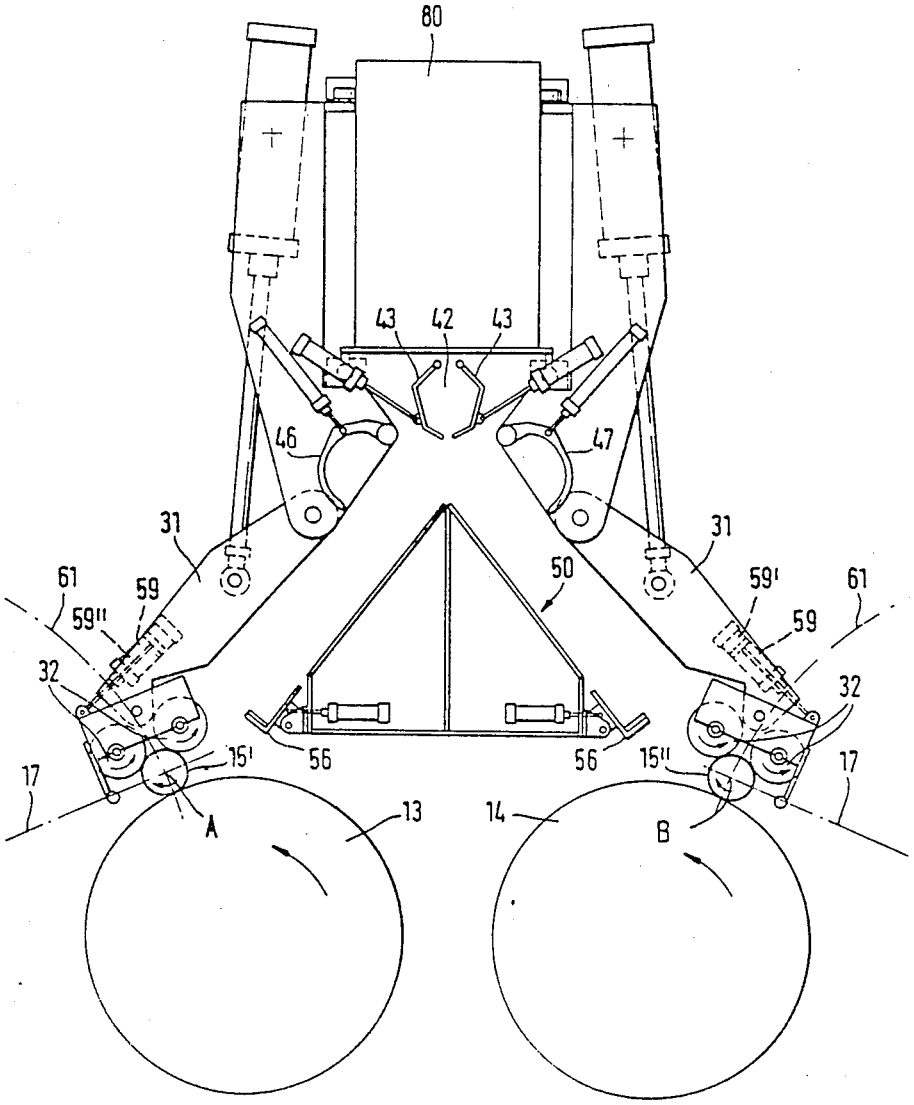

In the working phase shown in FIG. 9, the start of the winding operation is shown. The ends of the sub-webs 10', 10" have been secured to the associated winding tubes 15', 15". The roller rockers 36 have been pivoted with respect to the roller cranks 31 in such a manner that the two pressure rollers 32 bear from above on the respective winding tubes 15', 15" so that the tubes are satisfactorily entrained by friction at the support rollers 13, 14, and, in addition, support is provided against sagging caused by the web tension between the clamping means. Since the roller rockers 36 experience torque acting differently with regard to the linear actuators effecting the pivoting thereof, in the right linear actuator 59 in FIG. 1, the piston 59' and in the left linear actuator 59, the piston 59" must be activated.

The support rollers 13 and 14, the winding tubes 15' and 15" driven thereby and the pressure rollers 32 start moving at the beginning of the winding operation in the direction of rotation indicated by the arrows in FIG. 9.

Figure 10:
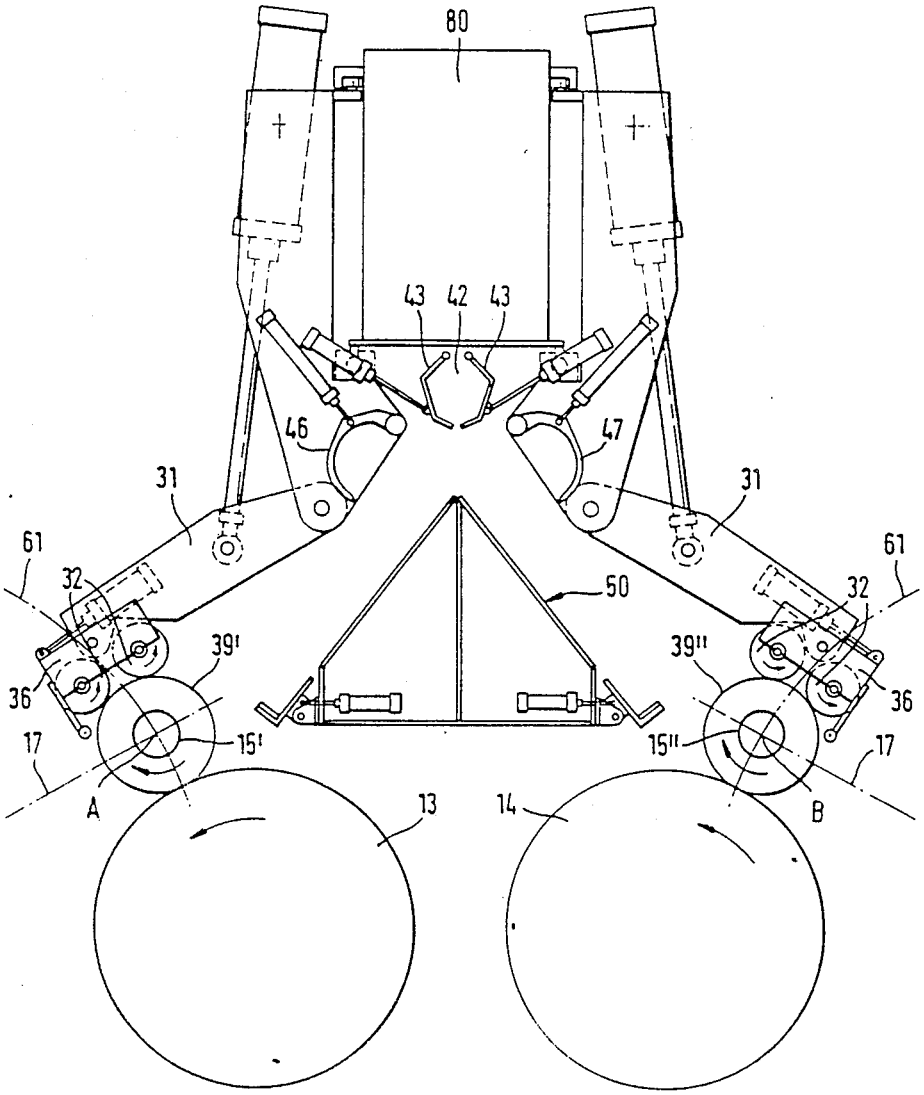

In the working phase according to FIG. 10, the sub-rolls 39', 39" are already partially formed on the winding tubes 15', 15". With increasing winding diameter of the sub-rolls 39', 39" the support arms 17 move upwardly, the winding tubes 15', 15" and the instantaneous winding axes A and B formed by their axes moving along the circular arc indicated by numeral 61. The roller cranks 31 are likewise pivoted upwardly. The roller rockers 36 adapt themselves in their orientation to the roller cranks 31 so that both pressure rollers 31 always bear on the sub-rolls 39', 39".

The winding is continued until the sub-rolls 39', 39" have reached the desired diameter. In the meantime, a new set of winding tubes 15 is inserted into the tubular magazine, and the transfer elements 46, 47 are pivoted back into the starting position shown in FIG. 3 beneath the tubular magazine 42.

The starting situation corresponding to FIG. 3 is thus again reached.

Figure 11:
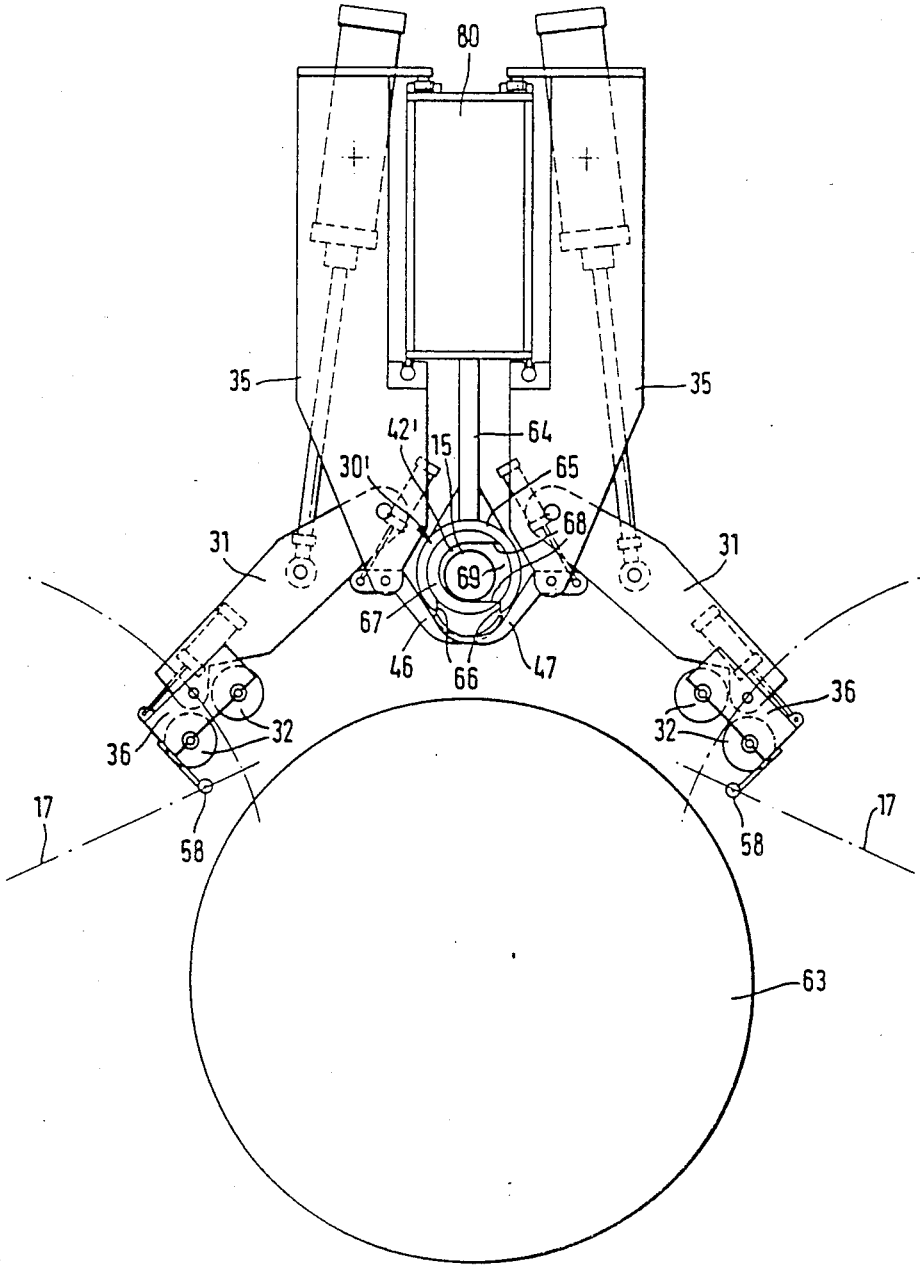
FIGS. 11 and 12 are views similar to those of FIG. 3 through 10, but show a modified embodiment of the core loading apparatus for use on a single drum winder in which the separate winding stations of each of two groups of winding stations are axially aligned, the groups being at spaced locations on the winding drum.
Figure 12:
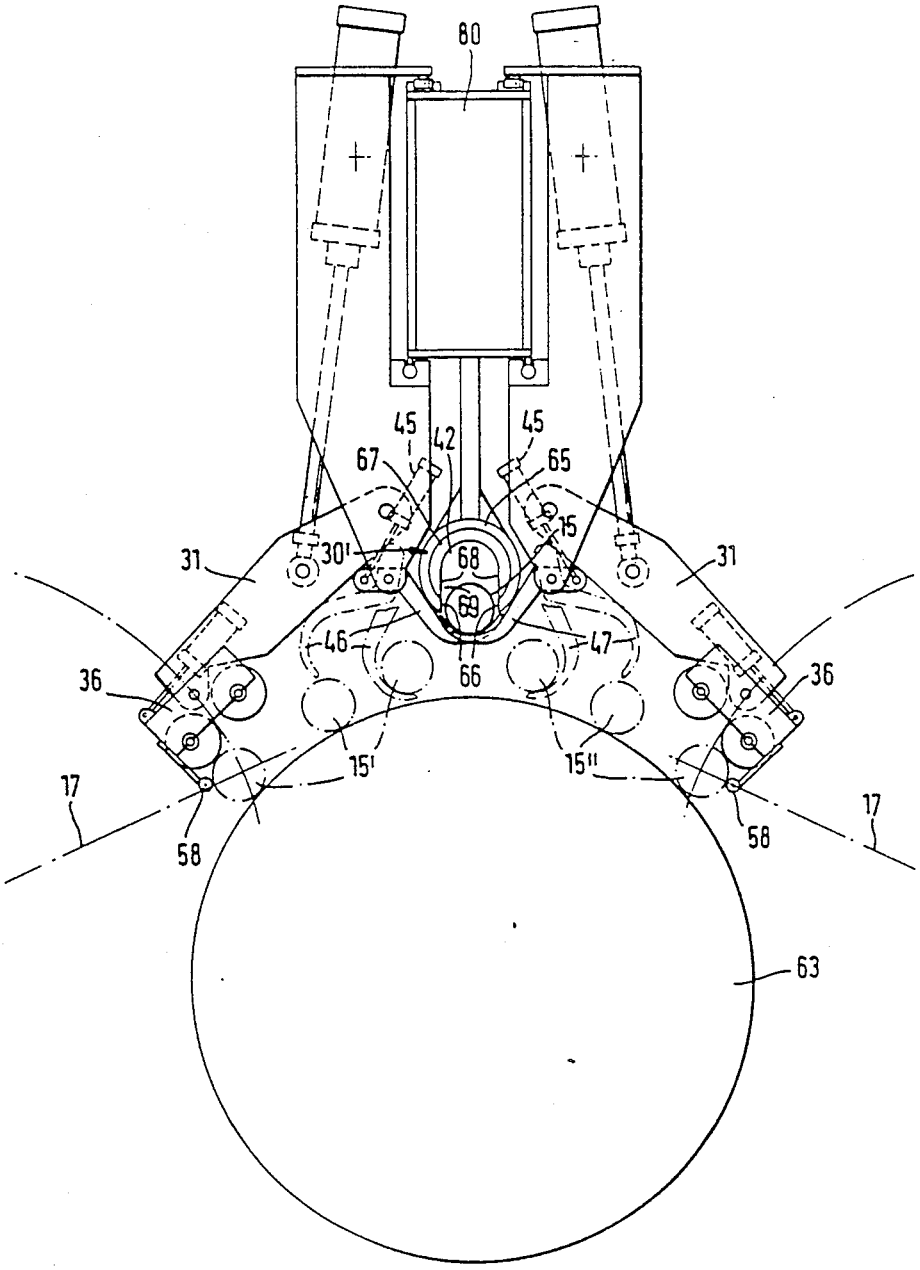

In FIGS. 11 and 12, an alternative embodiment is shown in which, instead of the two support rollers 13 and 14, a single support roller 63 of correspondingly larger diameter is present, on which winding is carried out at two locations. The receiver 30 is constructed differently from the embodiment according to FIGS. 3 to 10. In this embodiment, a guide device 50 is also not required. The function thereof is performed by the upper side of the single support roller 63.

With regard to the transfer elements 46, 47, the roller cranks 31 and the parts mounted thereon, as well as the carriages 35 and the entire function cycle, the embodiment according to FIGS. 11 and 12 corresponds to the previous embodiment.

The receiver 30' includes downwardly slit bearing rings 65 which are mounted on vertical supports 64 on the lower side of the box beam 80. The slot of the bearing rings 65 is defined by two parallel walls 66 which are spaced apart a distance which is slightly greater than the outer diameter of the winding tubes 15. Several such bearing rings 65 are distributed over the width of the web. In the bearing rings 65 a matching magazine tube 67 is rotatably mounted which extends continuously over the width of the web and which is longitudinally slit, the longitudinal slot 69 having parallel walls 68 spaced apart corresponding to the spacing of the walls 66. The walls 68 lead tangentially up to the inner periphery of the magazine tube 67, the inner diameter of which corresponds to the outer diameter of the winding tubes 15. The magazine tube 67 is pivotal about its longitudinal axis through at least about 90° by a drive which is not shown. With large supply roll widths, the magazine 67 may also be divided in the center or at several locations along its length, and provided with pivot drives at each section thereof.

The winding tubes 15 are inserted lengthwise consecutively from one side of the roll cutting machine into the magazine tube 67, which is then in the position shown in FIG. 11 , in which the slot 69 defined by the walls 68 is directed to the right and against the inner periphery of the bearing rings 65. The winding tubes 15 thus cannot fall out of the receiver 30' forming a tubular magazine.

Figure 4:
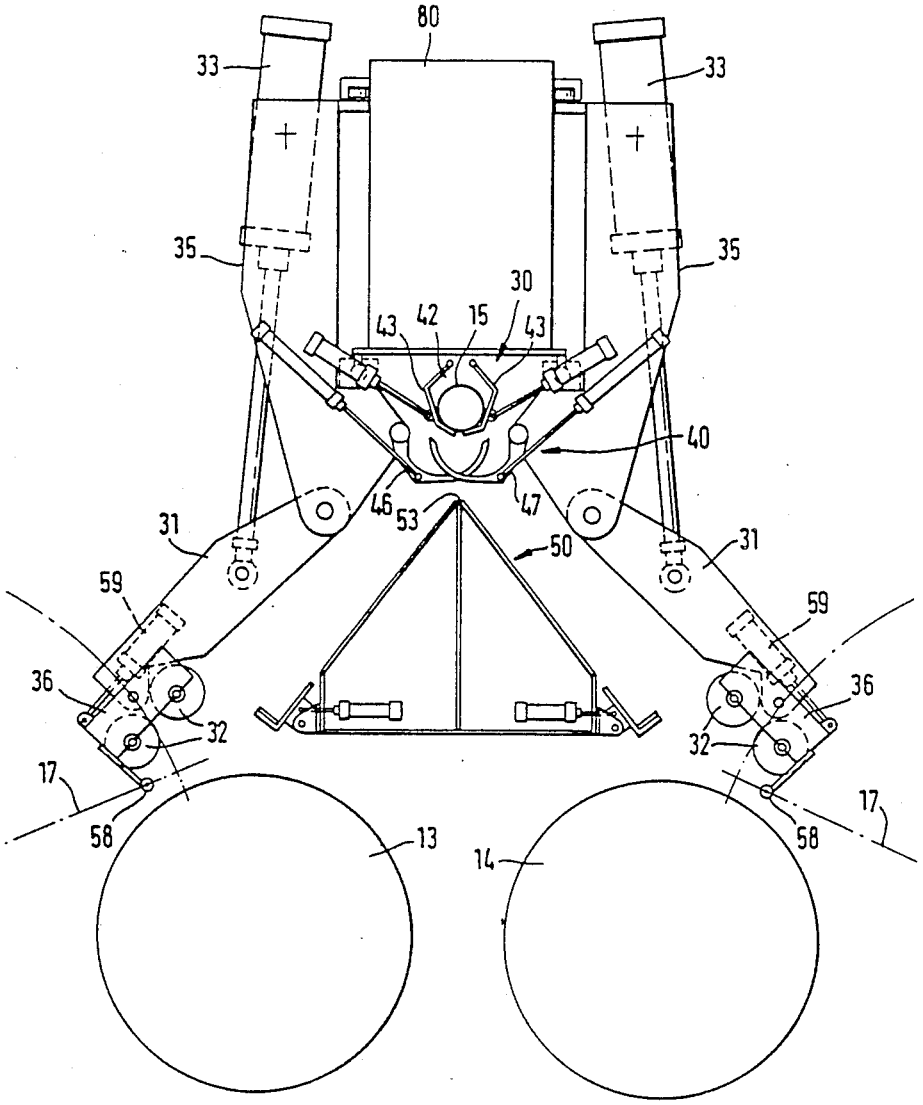
FIGS. 4 through 10 are views similar to that of FIG. 3, except that the rewound rolls have been removed and the FIGS. 4 through 10 show the stepwise procedure for loading new cores into the winding stations.

The working phase of FIG. 11 generally corresponds to that shown in FIG. 4 for the previous embodiment.

In FIG. 12, working phases are shown which correspond to those of FIGS. 5 and 7. To discharge the winding tubes 15 from the tubular magazine 42', the magazine tube 67 is rotated from the position according to FIG. 11 through 90° clockwise so that the slot 69 points downwardly, and the walls 68 of the slot in magazine tube 67 align with the walls 66 of the slot of the bearing rings 65. The winding tubes 15 then drop out of the magazine tube 67 downwardly into the ready-to-receive transfer elements 46, 47 which engage beneath the tubular magazine 42' and which are shown in full line in FIG. 12 in this position. This phase corresponds to FIG. 5.

Thereafter, the transfer elements 46, 47 are moved by the linear actuators 45 through an intermediate position in which the separation of the winding tubes 15', 15" belonging to the two winding axes has already been completed, into a final position shown in dot-dash line in which the winding tubes 15' and 15" roll down over the upper side of the support roller 63 along both sides, until the winding tubes come to bear on the further stops 58 at the outer side of the roller rockers 36. This corresponds to the phase according to FIG. 7. The initial winding then takes place in the manner described for the previous embodiment.

The magazine tube 67 is then returned to the position shown in FIG. 11 in which the slot defined by the walls 68 points to the right, so that when the new set of winding tubes 15 is inserted the tubes cannot prematurely drop out downwardly.

The embodiment of FIGS. 11 and 12 is somewhat simpler in construction and stability than that of FIGS. 3 to 10 because the receiver 30' encloses only the rotatable magazine tube 68. This embodiment is also more compact because the guide device 50 is replaced by the upper side of the single support roller 63, and is therefore no longer necessary. If, however, the embodiment according to FIGS. 11 and 12 is used in a winder having two support rollers, then a guide means 50 will normally be required because the released winding tubes may otherwise drop between the two support rollers.

While several embodiments of a core loading mechanism for web cutting machines have been shown and described in detail herein various other changes and modifications may be made without departing from the scope of the present invention.

I claim:

1. A core supply apparatus for a web slitting machine on which a wide roll of a web of paper or the like can be divided into a plurality of narrower rolls, which machine includes an unwinding station for the wide roll, a cutting station in which the wide web is longitudinally divided into sub-webs by means of at least one longitudinal cutting means, and a take-up station having a plurality of take-up units by means of which the sub-webs are wound into narrower rolls, the take-up units being arranged in different groups of take-up units and the take-up units of a first group having substantially aligning winding axes which are spaced from substantially aligning winding axes of a second group; said core supply apparatus comprising:

a receiver for holding all winding cores for all take-up units of each group, said receiver holding the winding cores coaxially in series and being adapted for receiving the winding cores inserted from one end;

releasing means for dropping the winding cores out of said receiver;

a transfer mechanism for accepting the winding cores as they are dropped from said receiver, said transfer mechanism including transfer elements for each group, said elements having pivotal connections, free ends and curved surfaces overwhich the cores pass away from the free ends as the cores are accepted by said transfer mechanism for separating the cores into groups; and actuator means for moving said transfer elements of said transfer mechanism about said pivotal connections, causing cores thereon to pass over the curved surfaces toward the free ends and to fall off the free ends.

2. A core supply apparatus as defined in claim 1, in which a guide device is associated with said transfer mechanism for receiving the winding cores falling from said free ends of said transfer mechanism and for guiding the winding cores to the respective take-up units.

3. A core supply apparatus as defined in claim 2, in which said receiver, said transfer mechanism, and said guide device are centrally located above two support rollers of the web slitting machine.

4. A core supply apparatus as defined in claim 2, in which said guide device includes sloping surfaces angling outward and downwardly from said transfer mechanism.

5. A core supply apparatus as defined in claim 4, in which stop elements are disposed on the downward edges of said downwardly sloping surfaces and said stop elements are pivotal downwardly and away from said surfaces.

6. A core supply apparatus as defined in claim 5, in which said stop elements are arranged above the support rollers.

7. A core supply apparatus as defined in claim 1, in which said receiver is a tubular magazine arranged horizontally and parallel to the winding axes.

8. A core supply apparatus as defined in claim 7, in which said tubular magazine consists of two elongated shells arranged generally opposed to each other and having pivotable connections at upper longitudinal edges, and said release means includes apparatus for pivoting said shells for opening a space between said shells at the bottom thereof through which space cores pass from said magazine.

9. A core loading mechanism for a web cutting machine in which at least a first sub-web is wound on a core operating on a first support roll, and at least a second sub-web is wound on a core operating on a second support roll, said core loading mechanism comprising:

a receiver for holding cores for roll winding to be formed at each of said support rollers;

transfer elements for receiving the cores from said receiver and for performing initial separation between cores for the first and second support rolls, said transfer elements including curved members receiving the cores near the ends thereof and providing generally concave surfaces along which the cores will travel;

actuator means for reorienting said transfer elements for causing cores on said transfer elements to roll off thereof; and a guide device receiving the cores from said transfer elements and directing the cores to each of said support rolls.

10. A core loading mechanism as defined in claim 9, in which said receiver is a tubular magazine disposed above said support rolls.

11. A core loading mechanism as defined in claim 10, in which said tubular magazine includes two elongated shells disposed in opposed relationship defining a substantially enclosed body for holding the cores, and separation means is provided for moving adjacent edges of said shells apart relative to each other for creating an opening through which cores can pass from said shells.

12. A core loading mechanism as defined in claim 9, in which said guide device includes downwardly sloping surfaces for receiving cores from said transfer mechanism and for directing the cores to the support rollers.

13. A core loading mechanism as defined in claim 12, in which said receiver is a tubular magazine disposed above said support rolls.

14. A core loading mechanism as defined in claim 13, in which said tubular magazine includes two elongated shells disposed in opposed relationship defining a substantially enclosed body for holding the cores, and separation means is provided for moving adjacent edges of said shells apart relative to each other for creating an opening through which cores can pass from said shells.

15. A core supply apparatus for a web slitting machine on which a wide roll of a web of paper or the like can be divided into a plurality of narrower rolls, which machine includes an unwinding station for the wide roll, a cutting station in which the wide web is longitudinally divided into sub-webs by means of at least one longitudinal cutting means, and a take-up station have a plurality of take-up units by means of which the sub-webs are wound into narrower rolls, the take-up units being arranged in different groups of take-up units and the take-up units of one group having substantially aligning winding axes which are spaced from substantially aligning winding axes of the other group; said core supply apparatus comprising:

a tubular magazine arranged horizontally and parallel to the winding axes for holding all winding cores for all take-up units of each group, said magazine holding the winding cores coaxially in series and being adapted for receiving the winding cores inserted from one end;

said tubular magazine including a tube having a longitudinal opening therein, said longitudinal opening having a width corresponding to at least the diameter of the winding cores; and means for rotating said tube about its longitudinal axes from a position in which the longitudinal opening is directed other than downwardly to a position in which the longitudinal opening is directed downwardly;

releasing means for passing the winding cores out of said magazine; and a transfer mechanism for accepting the winding cores from said magazine, said transfer mechanism being adapted for separating the cores into groups and for transferring the winding cores to the take-up units of each group.

16. A core loading mechanism for a web cutting machine in which at least a first sub-web is wound on a core operating on a first support roll, and at least a second sub-web is wound on a core operating on a second support roll, said core loading mechanism comprising:

a tubular magazine disposed above the support rolls for holding cores for roll winding to be formed at each of said support rollers;

said tubular magazine having a tube with a longitudinal opening therein, said tube being rotatable about its longitudinal axes for moving said longitudinal opening from an upwardly directed position in which cores remain in said tube to a downwardly directed position in which cores pass from said tube;

transfer elements for receiving the cores from said magazine and for performing initial separation between cores for the first and second support rolls; and a guide device receiving the cores from said transfer elements and directing the cores to each of said support rolls.

* * * * *